United States Patent [19]

Chen

[11] Patent Number: 4,551,336

[45] Date of Patent: Nov. 5, 1985

[54] INFUSION BAG

[76] Inventor: Ying-Cheng Chen, 3rd Fl., No. 29, La. 49, Jen Kung 1st Rd., Hsin Chu City, Taiwan

[21] Appl. No.: 564,337

[22] Filed: Dec. 22, 1983

[51] Int. Cl.[4] ..... B65B 29/04

[52] U.S. Cl. ..... 426/83; 426/77; 426/81; 99/323; 206/0.5; 493/226; 493/243; 493/926; 229/4.5; 53/134; 53/456; 53/452

[58] Field of Search ..... 426/77–84, 426/110, 112, 394; 206/0.5, 436; 99/323; 493/926, 226, 243; 53/134, 456, 452; 229/8, 4.5; 383/907

[56] References Cited

U.S. PATENT DOCUMENTS

| | | | |
|---|---|---|---|
| 693,913 | 2/1902 | Seney | 99/323 |
| 1,247,906 | 11/1917 | Ball | 426/84 |
| 1,473,430 | 11/1923 | Hirschhorn et al. | 426/84 |
| 1,489,806 | 4/1924 | Anderson | 53/456 |
| 1,894,346 | 1/1933 | Cooper | 53/456 |
| 2,328,017 | 8/1943 | Irmscher . | |
| 2,791,505 | 5/1957 | Barnett . | |
| 2,936,939 | 5/1960 | Lundquist | 229/8 |
| 3,115,967 | 12/1963 | Branstner . | |
| 3,539,355 | 11/1970 | Kasakoff . | |
| 3,542,561 | 11/1970 | Rambold . | |
| 3,597,222 | 8/1971 | Kalemba . | |
| 4,055,668 | 10/1977 | Kopp . | |
| 4,154,853 | 5/1979 | Rambold . | |
| 4,205,505 | 6/1980 | Zimmermann . | |
| 4,229,481 | 10/1980 | Fornari . | |
| 4,250,990 | 2/1981 | Casper . | |
| 4,278,691 | 7/1981 | Donarumma et al. | 206/0.5 |
| 4,290,521 | 9/1981 | Mitchell . | |
| 4,443,481 | 4/1984 | Donarumma et al. | 206/0.5 |

FOREIGN PATENT DOCUMENTS

| | | | |
|---|---|---|---|
| 1165822 | 3/1964 | Fed. Rep. of Germany | 206/0.5 |
| 2458223 | 1/1981 | France . | |
| 1575845 | 10/1980 | United Kingdom | 426/77 |
| 2053837 | 2/1981 | United Kingdom | 53/452 |

*Primary Examiner*—Steven Weinstein

*Attorney, Agent, or Firm*—Bert J. Lewen; Henry Sternberg

[57] ABSTRACT

An improved infusion bag for preparing an infusion of tea or other infusible substances, comprising a sachet member of liquid-permeable sheet material and a pull string. The pull string is joined at the upper apex of the sachet. At least one ventilative slit is provided below the joint point of the string and the upper apex of the sachet. The sachet can be folded into a generally tetragonal shape. After steeping, and by the action of withdrawing and submerging, the infusible substance swells and sinks to the lower apex of the sachet. The improved infusion bag makes the infusible substance less compacted and overcomes the constraint due to the capillarity of the liquid-permeable sheet material itself and the interface capillarity of the mass of the infusible substance. This gives a higher quantity and higher concentration of infusion liquor.

4 Claims, 11 Drawing Figures

INFUSION BAG

BACKGROUND OF THE INVENTION

1. Field of the Invention

This invention relates to an infusion bag and, more particularly, to an improved infusion bag that makes the infusible particles freely expand and improves the quantity and the speed of infusion of liquor flowing into and out of the infusion bag.

2. Description of the Prior Art

The prior art teaches various types of infusion bags, such as tea bags, for aiding the infusion of infusible particles. The infusible particles are packed in the lower end of the bags. After steeping, the infusible particles swell against one another and against packing sheets to form a compacted mass. The withdrawal and submerging of the bag causes the upper part of the packing sheets to adhere together, thereby permitting only limited quantities of infusion liquor to seep out of the bag. This is because the upper part of the bag is composed of substantially parallel sheets and also because of the interface capillarity of the compacted mass and the surface capillarity of the packing sheets. Furthermore, when the bag is withdrawn, only a limited quantity of liquor seeps out of the bag because no air can flow into the bag due to surface capillarity of the packing sheets. The atmospheric pressure forces the parallel packing sheets of the upper part of the bag to adhere together. The surface capillarity results from the liquor forming a thin film wetting the mesh of the packing sheets and the thin film makes the packing sheets air- and aroma-impermeable. Also, the surface capillarity of the packing sheets confines the aroma of infusion liquor in the hollow space of the bag. The interface capillarity of the compacted mass has the same effects and also forms bubbles between the particles of the infusible substance which limits the flow of the liquor into and out of the bag when the bag is withdrawn and submerged. Naturally, the smaller the quantity of infusion liquor seeping out of the bag, the smaller the quantity of infusion liquor which may reflow into the bag. Both surface capillarity and interface capillarity decrease infusion speed and lower infusion concentration.

In order to make infusion superior and to improve infusion speed, it is necessary to have a lower packing density, a larger packing space, and means for overcoming the surface capillarity of the packing sheets and the interface capillarity of the infusible compacted mass.

It is an object of this invention to provide a bag which overcomes the aforementioned inadequacies of the prior art bags and which allow an improved infusion of liquors.

Another object of this invention is to provide an improved infusion bag wherein the lower end of the bag is tapered to increase the infusion of liquor seeping out during withdrawal of the bag.

Another object of this invention is to provide an improved infusion bag wherein at least one ventilative slit is provided to overcome the surface capillarity of the packing sheets and the interface capillarity of the infusible compacted mass. Approximately fifty percent more in quantity of infusion liquor flowing into and out of the bag can be achieved. The slit is feasible only when the packing sheet is not parallel to the facing packing sheet. In this respect, the prior art bags can not be provided with a slit.

Another object is to provide an infusion bag of a three dimensional configuration which is easily folded into a flattened shape for easy packing in an envelope.

Another object is to provide an infusion bag wherein the packing sheets do not adhere together after steeping.

Another object is to provide an infusion bag wherein the internal volume to surface area ratio of the bag is larger than that of pillow-type, tetrahedral-type or tube-type bags.

Other objects will be apparent from the summary of the invention, the detailed description and the claims, taken in conjunction with the accompanying drawings.

SUMMARY OF THE INVENTION

This invention relates to an infusion bag for tea or the like, which comprises a sachet member having first and second cones of liquid-permeable sheet material, a transverse seam joining the two cones along the common cone-base circumference. Additionally, the apexes of the two cones are arranged at opposite sides of the transverse seam and one longitudinal seam extends from the apex of the first cone to the apex of the second cone. The two cones, neither being enclosed by a cone base face, define a three dimensional hollow internal space wherein tea or another infusible substance may be packed. A pull-string for handling the bag is joined near to the apex of the first cone of the sachet. A tag may be joined at the other end of the string. This configuration has a larger internal volume to surface area ratio than that of any prior art, including pillow-type or tetrahedral-type bags. For a constant surface area, the bag of the invention has an internal volume of approximately ninety percent and fifty percent larger than that of pillow-type or tetrahedron-type bags, respectively. In this respect, sheet material is saved. At least one ventilative slit is cut on the surface of the first cone just below the points where the string is joined to the apex of the first cone. The slit is perpendicular to and centered on a line extending from the apex to the base of the first cone. The sachet may be flattened on any pair of folding lines both extending from the apex of the first cone to the apex of the second cone along the cone surfaces and at opposite sides of each cone. In its flat form the bag can be easily packed in an envelope.

Initially, the infusible substance is packed in the hollow space of the sachet and then the sachet is flattened. During steeping, the infusible substance swells and expands. After a few minutes, by the action of withdrawing and sumberging, the infusible substance sinks down to the lower part of the sachet and expands the flattened sachet into the three dimensional configuration. Since the infusible substance is swollen first, the action of withdrawing and submerging makes it less compacted.

The downwardly tapered ends of the second cone of the bag allows the infusion liquors to flow together and seep out during the withdrawal of the bag. The increased quantity of infusion liquor flowing in after submerging the bag improves infusion speed and increases the concentration of the infusion liquor.

At least one ventilative slit is provided near the apex of the first cone of the bag. The slit opens while withdrawing the bag to allow the aroma of the infusion liquor to be released. Also it allows air flow into the bag to further increase the quantity of infusion liquor seeping out of the bag. The surface capillarity of the packing sheets and interface capillarity of the infusible substance do not confine the aroma and infusion liquor to the inside of the bag. The slit opens because of the opposite forces exerted on the slit, i.e., the pulling force exerted upwardly by withdrawing the bag and the gravitational force exerted downwardly. The slit closes due to inertia when no force is exerted on the slit, as, for example, when the bag is floating in the liquor. Since the slit is provided near the upper end of the bag and the infusible substance is packed and swells in the lower half of the bag, particles of the infusible substance have little chance of flowing out of the bag through the slit.

After steeping, the infusible substance swells and fills up the lower half of the sachet to expand the sachet into a three dimensional configuration. During withdrawal of the bag, four forces are exerted on any part of the packing sheet of the sachet: the pulling force of the hand, the gravitational force on the sachet, the tensile force exerted by the compacted mass, the compressive force exerted by packing sheets. These forces prevent the packing sheets from adhering together and open and close the slit.

DETAILED DESCRIPTION OF THE INVENTION

Figure 1:
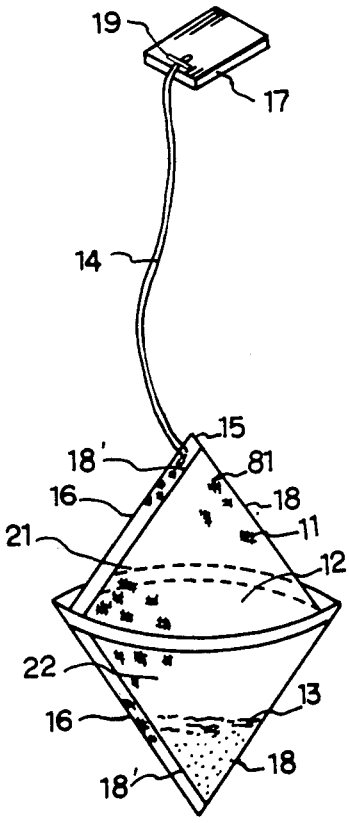
FIG. 1 is a perspective view of an improved infusion bag in three dimensional configuration.
Figure 2:
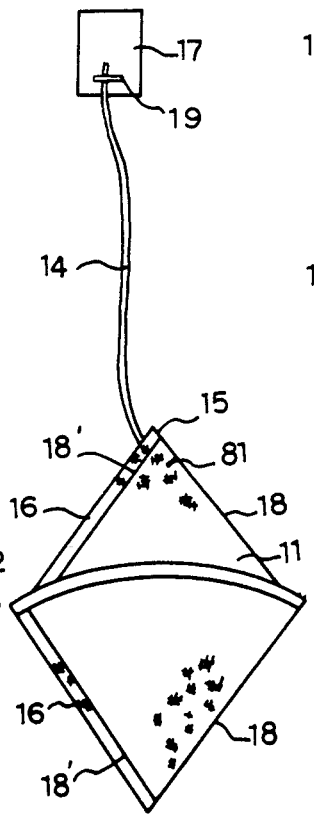
FIG. 2 is a front view of an improved infusion bag shown in FIG. 1.
Figure 3:
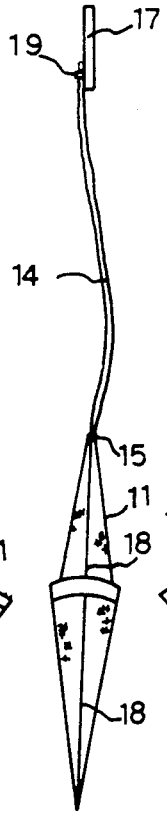
FIG. 3 is a side view of an improved infusion bag shown in FIG. 1.
Figure 4:
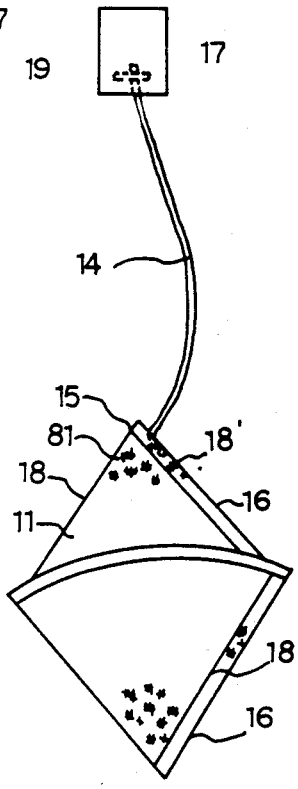
FIG. 4 is a rear view of an improved infusion bag shown in FIG. 1.
Figure 5:
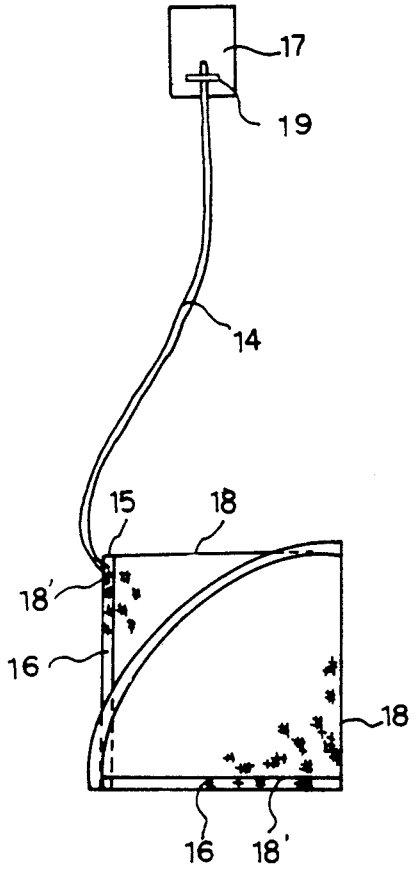
FIG. 5 shows the bag collapsed into a square shape and the preferred embodiment wherein the bag is composed of two half circle packing sheets.

Referring to FIG. 1, an infusion bag of liquid-permeable sheet material 11, such as filter paper, comprises a sachet member 12 of a first cone 21 and a second cone 22, wherein infusible substance 13 is packed; a pull string 14 is joined at the tapered end 15 of the first cone 21; and a tag 17 is joined to the other end of the string 14 at seam 19. Referring to FIGS. 2, 3 and 4, a pair of folding lines 18, 18' are shown on which the bag may be flattened into tetragonal shape. FIG. 5 shows a special embodiment of the bag composed of two pieces of half circular sheet material. The flat form of this special embodiment is square. It is convenient to pack the square form of the bag into rectangular envelopes and pack tens of envelopes into a box for displaying or stocking.

Figure 6:
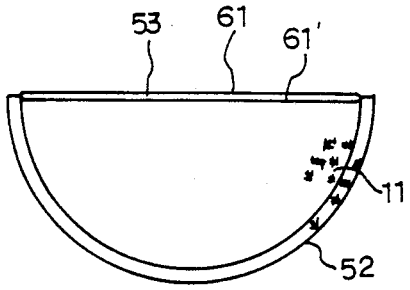
FIG. 6 illustrates two pieces of half circular sheet material overlap together and the arcuate seam made during manufacture.
Figure 7:
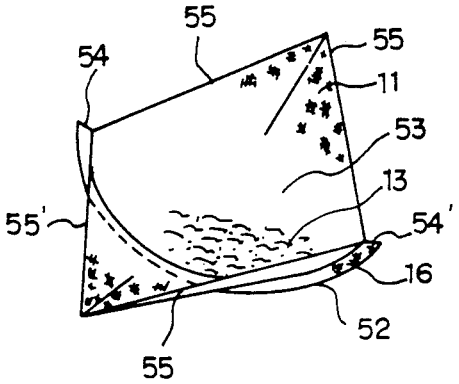
FIG. 7 illustrates the filling of the infusible substance into the preferred embodiment of the bag during manufacture.
Figure 8:
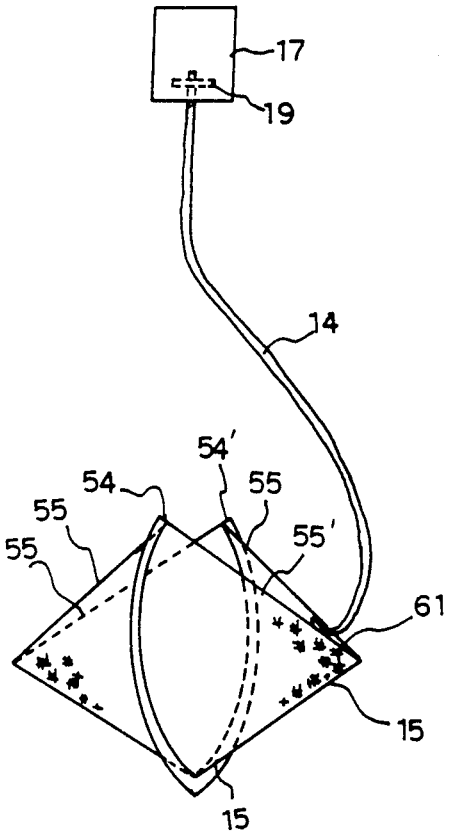
FIG. 8 illustrates the pull string seamed to the bag and the longitudinal seam enclosing the infusible substance during manufacture.
Figure 9:
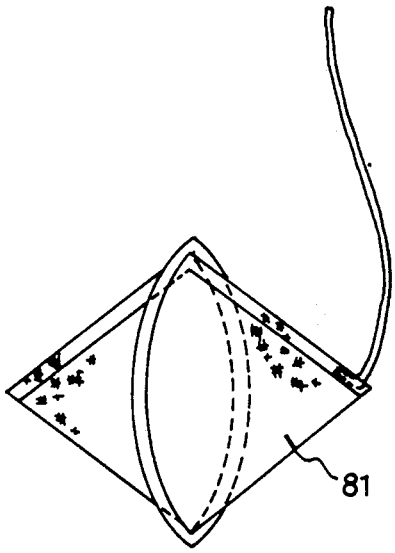
FIG. 9 illustrates the ventilative slit on the preferred embodiment of the bag.
Figure 10:
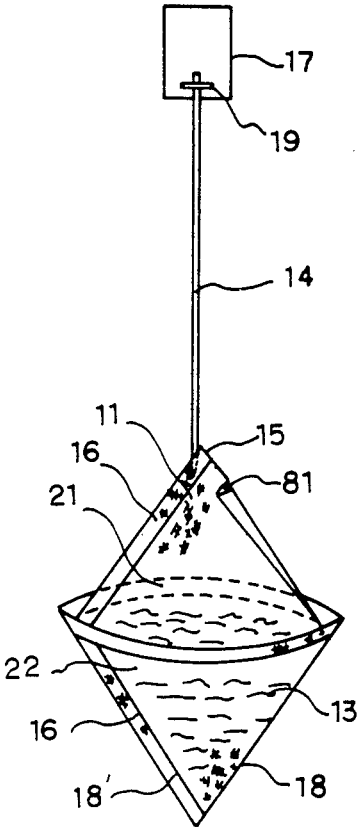
FIG. 10 illustrates the perspective view of the bag after steeping.
Figure 11:
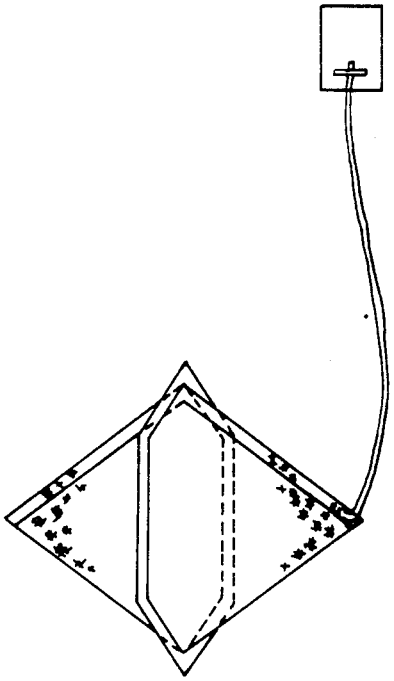
FIG. 11 is a perspective view of another embodiment of the invention with polygonal cones instead of circular cones.

Manufacture of the preferred embodiment of the invention is shown in FIGS. 6 through 10. Initially, as shown in FIG. 6, two semi-circular sheets are overlapped one upon the other and seamed around the circumferential edge 52. This seam ultimately forms the common cone base circumference. The flat edges of the semi-circular sheets remain unattached and may be readily opened to permit filling with infusible particles such as tea. After the infusible particles are added, the two cones are formed by bringing together the opposite ends of the diameters 61 and 61'. These ends are identified by numerals 54 and 54' in FIG. 8. By thus folding the material, the diameters 61 and 61' are bisected to form the radii 55 and 55', respectively. These radii are joined together to form the longitudinal seams 16 shown in FIG. 10. At the same time, one end of a pull string 14 is seamed at the corner 61 encompassed by the pair of radii. Referring to FIG. 9, one ventilative slit 81 is cut open on the surface of the first cone and below the joint point of the string and the first cone. The slit is perpendicular to the line extending from the apex of the first cone through the center of the slit to the cone base circumference. The length of the slit is preferably about two to five millimeters. After steeping, when the bag is withdrawn, the slit 81 opens. This is shown in FIG. 10. The other end of the pull string 14 is attached to tag 17 at seam 19. The above seam may be formed by heat sealing if the liquid-permeable sheet material has been coated with hot melt plastics or hot melt glue beforehand. Alternatively, adhesive sealing may be used.

The invention may be embodied in other specific forms without departing from the spirit or essential characteristics thereof. The present embodiment is therefore to be considered in all respects as illustrative and not restrictive, the scope of the invention being described by the appended claims.

What I claim is:

1. An infusion bag containing infusible substances, comprising a sachet member of liquid-permeable sheets having first and second cones; a transverse seam joining said two cones along a common cone-base circumference, the apexes of said cones being formed at opposite sides of said transverse seam; a longitudinal seam extending from the apex of said first cone to the apex of said second cone; thereby forming a three dimensional hollow internal space wherein said infusible substance is packed; and a pull string, one end of which is joined near the apex of said first cone.

2. The infusion bag according to claim 1, wherein at least one ventilative slit is provided on the surface of said first cone and below the point where said string is joined to said first cone, said slit being perpendicular to a line extending from the apex of said first cone to said transverse seam.

3. The infusion bag according to claim 1, wherein said first cone and said second cone are circular cones.

4. The infusion bag according to claim 1, wherein a pair of folding lines both extend from the apex of said first cone to the apex of said second cone along said cone surfaces and are arranged at opposite sides, so that when said bag is flattened on said folding lines it forms a generally tetragonal shape.

* * * * *